US010907517B2

(12) United States Patent
Qi et al.

(10) Patent No.: US 10,907,517 B2
(45) Date of Patent: Feb. 2, 2021

(54) SILENCER AND VEHICLE ENGINE INCLUDING SAME

(71) Applicant: MANN+HUMMEL GmbH, Ludwigsburg (DE)

(72) Inventors: Yun Qi, Shanghai (CN); Weixin Jia, Shanghai (CN)

(73) Assignee: MANN+HUMMEL GmbH, Ludwigsburg (DE)

( * ) Notice: Subject to any disclaimer, the term of this patent is extended or adjusted under 35 U.S.C. 154(b) by 442 days.

(21) Appl. No.: 15/875,074

(22) Filed: Jan. 19, 2018

(65) Prior Publication Data

US 2018/0142588 A1 May 24, 2018

Related U.S. Application Data

(63) Continuation of application No. PCT/EP2016/065117, filed on Jun. 29, 2016.

(30) Foreign Application Priority Data

Jul. 23, 2015 (CN) ..... 2015 1 0436110

(51) Int. Cl.

| | |
|---|---|
| ***F01N 1/02*** | (2006.01) |
| ***F02M 35/12*** | (2006.01) |
| ***F01N 1/00*** | (2006.01) |
| ***F01N 13/14*** | (2010.01) |

(52) U.S. Cl.

CPC ..... *F01N 1/026* (2013.01); *F01N 1/003* (2013.01); *F01N 13/14* (2013.01); *F02M 35/1261* (2013.01); *F02M 35/1266* (2013.01); *F01N 1/006* (2013.01); *F01N 1/023* (2013.01); *F01N 2470/02* (2013.01); *F01N 2470/24* (2013.01)

(58) Field of Classification Search

CPC ..... F01N 1/026; F01N 1/003; F01N 13/14; F01N 1/006; F01N 1/023; F01N 2470/24; F01N 2470/02; F02M 35/1266; F02M 35/1261

USPC ..... 181/227

See application file for complete search history.

(56) References Cited

U.S. PATENT DOCUMENTS

| | | | |
|---|---|---|---|
| 2,904,125 A | 9/1959 | Bourne et al. | |
| 4,589,517 A | 5/1986 | Fukuda | |

(Continued)

FOREIGN PATENT DOCUMENTS

| | | | |
|---|---|---|---|
| EP | 1507071 A1 | 2/2005 | |
| EP | 2444605 A1 * | 4/2012 | ..... F01N 1/22 |

(Continued)

*Primary Examiner* — Forrest M Phillips
(74) *Attorney, Agent, or Firm* — James Hasselbeck

(57) ABSTRACT

A silencer having an outer housing; and a central perforated tube through which air flows. The silencer further includes an additional perforated structure located between the central perforated tube and the outer housing, a first chamber is formed between the central perforated tube and the additional perforated structure, and the additional perforated structure is configured such that at least one second chamber is formed, which is at least partially located radially outside of the first chamber, where the second chamber is communicated with the first chamber by perforates. The disclosure further relates to a vehicle engine having the silencer. The silencer is compact in structure, and has a better broadband silencing effect.

12 Claims, 2 Drawing Sheets

(56) References Cited

U.S. PATENT DOCUMENTS

| | | | | |
|---|---|---|---|---|
| 7,997,382 | B2 * | 8/2011 | Hagiwara | F01N 1/04 181/227 |
| 2002/0036114 | A1 * | 3/2002 | Tobias | F01N 1/16 181/241 |
| 2005/0161283 | A1 * | 7/2005 | Emler | F01N 1/003 181/249 |
| 2009/0000282 | A1 * | 1/2009 | Gruber | F01N 1/084 60/299 |
| 2009/0101434 | A1 * | 4/2009 | Sammut | F01N 13/1888 181/227 |
| 2012/0292128 | A1 * | 11/2012 | Keesser | F01N 13/16 181/227 |
| 2013/0126266 | A1 * | 5/2013 | Luttig | F01N 1/006 181/227 |
| 2016/0201530 | A1 * | 7/2016 | Brown | F01N 1/086 181/227 |

FOREIGN PATENT DOCUMENTS

| | | | |
|---|---|---|---|
| GB | 450398 | A | 7/1936 |
| GB | 610000 | A | 10/1948 |

* cited by examiner

SILENCER AND VEHICLE ENGINE INCLUDING SAME

CROSS-REFERENCE TO RELATED APPLICATIONS

This application is a continuation of International Application No. PCT/EP2016/065117, filed 29 Jun. 2016 and designating the United States, which claims the benefit of China Application No. CN 201510436110.7, filed 23 Jul. 2015. The entire contents of the aforesaid international application and the aforesaid China application being incorporated herein by reference.

TECHNICAL FIELD

The present invention relates to a silencer, which includes an outer housing and a central perforated tube through which air flows. The present invention further relates to a vehicle engine including a silencer.

BACKGROUND

Small-displacement turbocharged engines are an important development in the direction of energy-efficient vehicles. A turbocharged engine improves the power and fuel economy of the vehicle, but also introduced a new problem of noise for an air inlet system, thereby severely impacting the rider's comfort of the vehicle. The howling generated by a turbocharger adopting a mechanical relief valve during instant operation belongs to typical broadband noises. A conventional silencer has a narrow silencing frequency range and cannot efficiently suppress this type of noise, and also has high cost and large size.

Perforated broadband silencers are widely applied in air inlet systems of turbocharged engines as excellent silencing elements meeting requirements of both silencing and mounting space, and each include a main tube and several annular resonance chambers. A desirable broadband silencing effect can be achieved by adjusting the width, diameter and number of the annular resonance chambers and the aperture and number of perforates.

When the perforated silencer is used in a turbocharged engine, the diameter of an air flow main tube depends on the tube diameter of the air inlet system, and the outer diameter of the annular resonance chamber is limited by the mounting space of an engine compartment. Therefore, the design of the perforated silencer having the expected silencing effect may be constrained in various terms including structure and size. Moreover, it is further required in practice that the perforated silencer has small flow loss.

However, the existing perforated silencer cannot, at times, achieve the expected silencing effect due to limitations such as the mounting space, and is complicated in structure and high in cost.

SUMMARY

An objective of the present invention is to provide a silencer having a more compact structure and desirable broadband silencing effect and a corresponding vehicle engine.

According to a first aspect of the present invention, a silencer is provided, including: an outer housing; and a central perforated tube through which air flows; where the silencer further includes an additional perforated structure located between the central perforated tube and the outer housing; a first chamber is formed between the central perforated tube and the additional perforated structure; and the additional perforated structure is configured such that at least one second chamber is formed, which is at least partially located radially outside of the first chamber, wherein the second chamber is communicated with the first chamber by perforates.

According to an optional solution of the present invention, the additional perforated structure is configured as an additional perforated tube which is mounted over the central perforated tube.

According to an optional solution of the present invention, the additional perforated tube is disposed concentrically with the central perforated tube; and/or the additional perforated tube and/or the central perforated tube has circular cross section; and/or the first chamber and/or the second chamber has annular cross section.

According to an optional solution of the present invention, the central perforated tube is adapted to be connected to or integrally formed with a first end pipe section located axially outside of the outer housing, and the additional perforated tube is adapted to be connected to or integrally formed with a second end pipe section located axially outside of the outer housing, wherein the first end pipe section and the second end pipe section are located at axial opposite sides of the central perforated tube.

According to an optional solution of the present invention, the second chamber is configured so as to be completely located radially outside of the first chamber; and/or the second chamber and the first chamber have the same axial length and are aligned axially with each other.

According to an optional solution of the present invention, the second chamber is configured so as to only be in a partial circumferential region of the central perforated tube.

According to an optional solution of the present invention, the second chamber is configured as a box-shaped structure which has a radially-outward opening, and the outer housing has a cover plate adapted to close the opening.

According to an optional solution of the present invention, the first chamber and/or the second chamber is separated axially into a plurality of sub-chambers, communicated with each other via a perforated member.

According to an optional solution of the present invention, the silencer is adapted for use in an air inlet system of a vehicle engine; and/or the at least one second chamber comprises a plurality of second chambers which are located radially with respect to each other, and the adjacent second chambers are communicated with each other via perforates.

According to a second aspect of the present invention, an air inlet system of a vehicle engine is provided, where the air inlet system has the silencer.

The silencer of the present invention has a compact structure and better broadband silencing effect, especially when it is used in an air inlet system of a vehicle engine, the broadband noise of the air inlet system can be obviously suppressed.

According to this invention, the silencer and the air inlet system are not limited to an engine of a vehicle but also incorporate a silencer or an air inlet system for a stationary engine, e.g. a power generator. The invention is not limited to an exhaust gas turbo charged engine but also incorporates a silencer and an air inlet system for any other engine charged by other devices like mechanical compressors or electrical driven air chargers.

BRIEF DESCRIPTION OF THE DRAWINGS

The present invention will be described in more detail below with reference to the accompanying drawings, and principles, characteristics and advantages of the present invention may be better understood. The accompanying drawings include.

DETAILED DESCRIPTION

In order for the technical problems to be solved, the technical solutions and beneficial technical effects of the present invention must be clear and more comprehensive. The present invention will be further described in detail through the accompanying drawings and multiple embodiments. It should be understood that the specific embodiments described herein are merely used to explain the present invention, and are not intended to limit the protection scope of the present invention.

Figure 1:
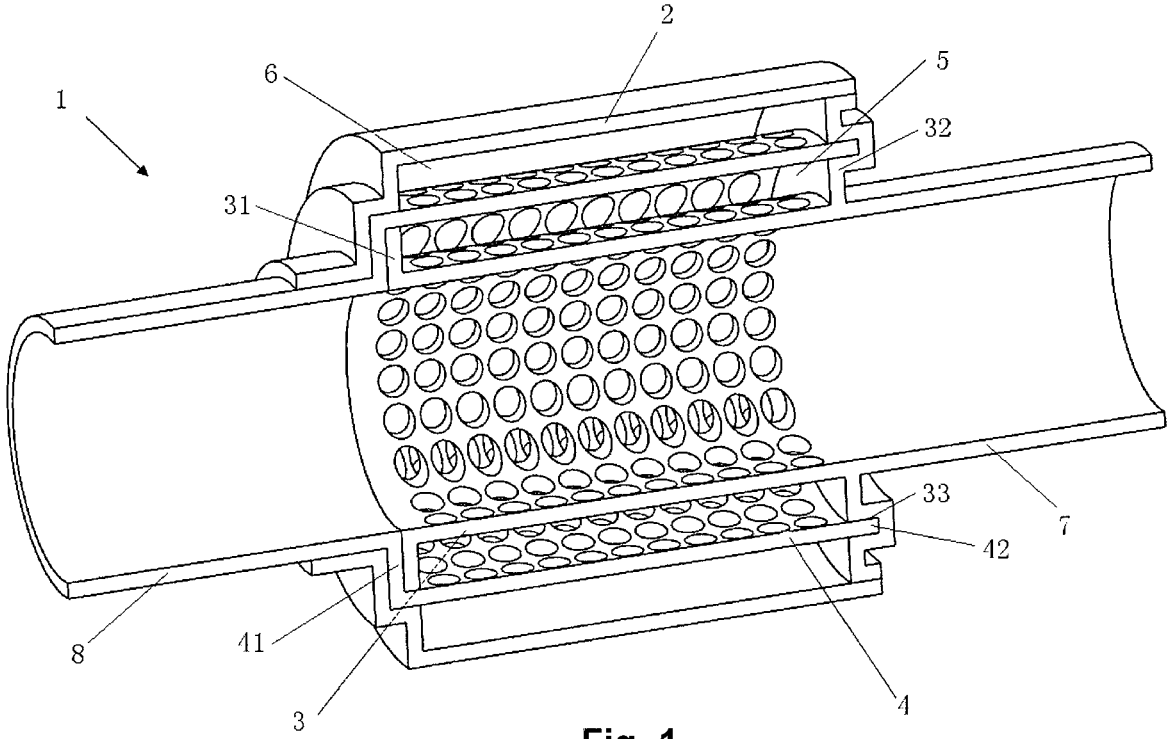
FIG. 1 shows a three-dimensional sectional diagram of a perforated broadband silencer according to an exemplary embodiment of the present invention.

FIG. 1 shows a three-dimensional sectional diagram of a perforated broadband silencer according to an exemplary embodiment of the present invention.

As shown in FIG. 1, the silencer 1 mainly includes an outer housing 2, a first perforated tube 3 and a second perforated tube 4 mounted over the first perforated tube 3, where, the outer housing 2 is mounted over the second perforated tube 4. Preferably, the first perforated tube 3 is disposed concentrically with the second perforated tube 4. A first chamber 5 is formed between the first perforated tube 3 and the second perforated tube 4, and a second chamber 6 is formed between the second perforated tube 4 and the outer housing 2, so as to form two chambers communicated with each other by perforates in a radial direction relative to the air flow.

During use, an air inlet silencer is generally mounted on a main pipeline between an air cleaner and a turbocharger, or between the turbocharger and an intercooler. Preferably, the first perforated tube 3 is made to have a diameter equal to that of the main pipeline. As shown in FIG. 1, the first perforated tube 3 is integrally formed with a first end pipe section 7 extending outside of the outer housing 2; the second perforated tube 4 is also integrally formed with a second end pipe section 8 extending outside of the outer housing 2. Preferably, the first end pipe section 7, the first perforated tube 3, and the second end pipe section 8 have the same diameters, and are disposed concentrically.

During mounting, the silencer 1 is embedded into a corresponding main pipeline through the first end pipe section 7 and the second end pipe section 8, or the first end pipe section 7 and the second end pipe section 8 are integrally formed with the main pipeline.

In view of the above, the intake silencer has two chambers communicated with each other in the radial direction, and the chambers, together with perforates in the first and second perforated tubes, form a Helmholtz resonance chamber structure. When the air flow passes through the first perforated tube, the Helmholtz resonance chamber structure may generate an attenuation effect on the broadband noise. As being proved by experiments, compared with the conventional perforated silencer having only one chamber in the radial direction, the perforated silencer having multiple chambers communicated with each other in the radial direction has a better silencing effect, especially having a desirable silencing effect for any frequency in a broad frequency band. Moreover, the silencer in such configuration is compact in structure and low in cost, and can be mounted in a limited space.

It is understandable that changes of parameters such as the aperture, the percentage of perforation, the length of the perforated tube and the chamber capacity may also affect the silencing effect to some extent, and the silencer may be further optimized based on these parameters in practice.

To simplify the structure and facilitate mounting, as shown in FIG. 1, the first perforated tube 3 is provided with a first flange 31 and a second flange 32 that extend outward radially, and the second perforated tube 4 is transited to the second end pipe section 8 through a step 41. During mounting, the first flange 31 is pressed against the step 41, an end 42 of the second perforated tube 4 is embedded into a receiving groove 33 formed in the second flange 32, and the outer housing 2 is mounted over the second perforated tube 4, so that one end of the outer housing 2 is attached to the second end pipe section 8 and the step 41, and the other end is connected to the second flange 32. All portions that need to be connected may implement connection by means of, for example, soldering.

Definitely, the first flange 31 may also be omitted, that is, the end of the first perforated tube 3 is directly pressed against the step 41.

The silencer needs three members in total, being simple in structure and convenient in mounting, thereby greatly reducing the manufacturing cost.

It should be noted that the silencer 1 shown in FIG. 1 has two chambers communicated with each other in the radial direction relative to the air flow. Definitely, the number of chambers is not limited to two, and more chambers are available.

On the other hand, the silencer 1 shown in FIG. 1 is provided with two chambers communicated with each other and arranged radially in the whole circumference; however, the present invention is not limited to this arrangement. According to requirements, for example, specific limits of the mounting space, it may also be allowed that two chambers communicated with each other are provided on a part of the circumference. For example, two chambers may be disposed merely at one side of the first perforated tube 3.

For a person skilled in the art, although the first chamber 5 and the second chamber 6 shown in FIG. 1 are both annular, the first chamber and the second chamber are not limited to these criteria, and any advantageous shape may be designed according to requirements as long as the two chambers (or more chambers) are arranged radially relative to each other and communicated with each other.

According to a preferred embodiment, the second chamber may be designed as a box-shaped structure. The box-shaped structure has a radially-outward opening and a cover plate for closing the opening. The cover plate is preferably connected to the opening by snapping, thereby simplifying mounting and manufacturing processes.

Moreover, according to the technical idea of the present invention, the first chamber 5 and the second chamber 6 may also have different axial lengths, and definitely, may also have different dimensions in other directions, as long as the first chamber and the second chamber are arranged at least partially in a radial position relation relative to each other.

Figure 2:
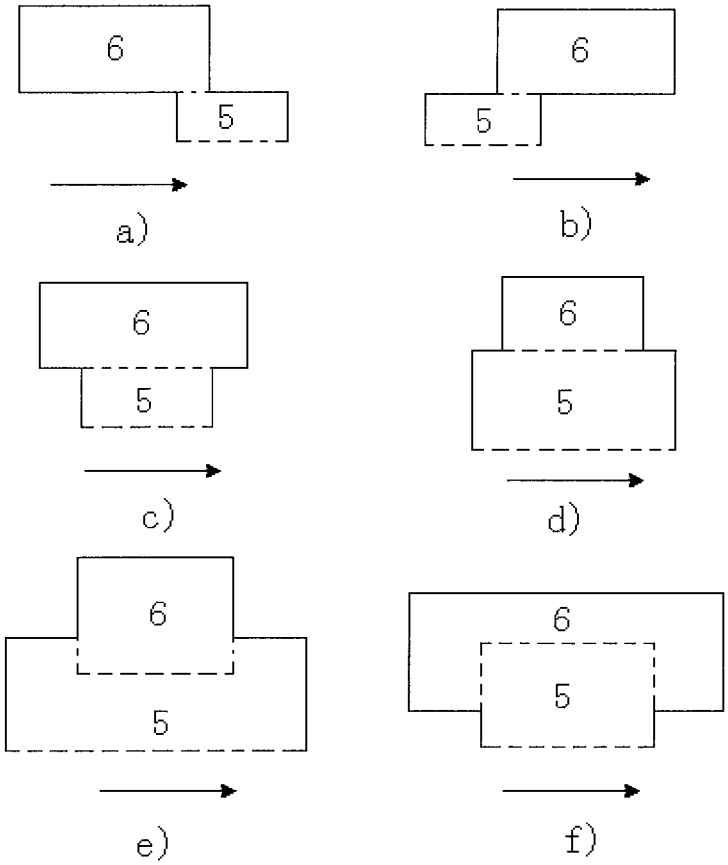
FIG. 2 shows some simplified schematic diagrams, illustrating some possible arrangements, position relations and size relations of a first chamber and a second chamber.

To better understand the technical idea of the present invention, FIG. 2 shows some simplified schematic diagrams, for illustrating some possible arrangements, position relations and size relations between the first chamber and the second chamber, where, an arrow indicates a flowing direction of the air flow passing through the first perforated tube.

In a) and b) of FIG. 2, the first chamber 5 and the second chamber 6 are partially staggered in an axial direction of flowing of the air flow, and the first chamber 5 and the second chamber 6 have different sizes. In c) of FIG. 2, the first chamber 5 is completely covered by the second chamber 6 in the axial direction, and in d) of FIG. 2, the first chamber 5 completely covers the second chamber 6 in the axial direction. In e) and f) of FIG. 2, the first chamber 5 and the second chamber 6 are partially overlapped in a radial direction relative to the air flow.

It should be noted that FIG. 2 merely shows some possible arrangement solutions, and they are not exhaustive. According to actual situations, other suitable arrangement solutions are viable, as long as the first chamber and the second chamber at least partially form a radial position relative to each other.

Figure 3:
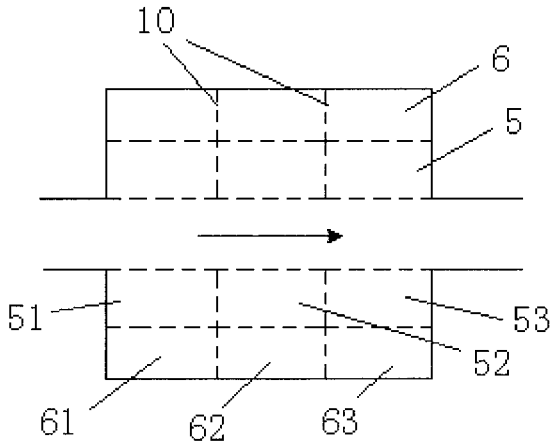
FIG. 3 shows a simplified schematic diagram of a perforated broadband silencer according to another exemplary embodiment of the present invention.

FIG. 3 shows a simplified schematic diagram of a perforated broadband silencer according to another exemplary embodiment of the present invention, where an arrow indicates a flowing direction of an air flow passing through a first perforated tube.

As shown in FIG. 3, the first chamber 5 and the second chamber 6 are both partitioned into multiple sub-chambers by perforated partition plates 10 substantially extending radially and/or axially. Specifically, the first chamber 5 is partitioned into three sub-chambers 51, 52 and 53, and the second chamber 6 is also partitioned into three sub-chambers 61, 62 and 63. The sub-chamber 51 is axially communicated with the sub-chamber 52, and the sub-chamber 52 is also axially communicated with the sub-chamber 53. Similarly, the sub-chamber 61 is axially communicated with the sub-chamber 62, and the sub-chamber 62 is also axially communicated with the sub-chamber 63. Moreover, the sub-chamber 51 is radially communicated with the sub-chamber 61. Similarly, the sub-chamber 52 is radially communicated with the sub-chamber 62, and the sub-chamber 53 is radially communicated with the sub-chamber 63. It can be seen that the sub-chambers are communicated with one another. This structure actually can be considered a serial connection of the structure shown in FIG. 1.

For persons skilled in the art, the embodiment shown in FIG. 3 is definitely exemplary. In fact, the first chamber 5 and the second chamber 6 may also adopt other partition manners. Even some sub-chambers may be omitted according to actual requirements, and some axially adjacent sub-chambers may not be communicated with each other; all these solutions fall within the scope of the present invention.

The basic idea of the perforated silencer of the present invention lies in that multiple chambers communicated with each other and arranged at least partially in a radial position relation relative to each other are provided at least in a partial circumferential region. By means of this structure, the silencer may achieve a better broadband silencing effect.

Although the perforated silencer is described by using a silencer for an air inlet system of a vehicle engine as an example, for persons skilled in the art, the perforated silencer definitely can be applied to other scenarios that require silencing the air flow.

Specific implementation manners of the present invention are described in detail here; however, they are provided merely for explanation, and should not be construed as limiting the scope of the present invention. Various replacements, variations and modifications may be conceived without departing from the spirit and scope of the present invention.

What is claimed is:

1. A silencer, comprising:

an outer housing;

a first pipe section having a first perforated outer wall, the first perforated outer wall arranged in an interior of the outer housing;

a second pipe section having a second perforated outer wall, the second perforated outer wall arranged in the interior of the outer housing, the second perforated outer wall having a larger diameter than the first perforated outer wall such that the second perforated outer wall is spaced radially outwardly away from and surrounding the first perforated outer wall;

a first chamber defined by radial spacing between a radially outer side of the first perforated outer wall and a radially inner side of the second perforated outer wall in the interior of the outer housing;

a second chamber defined by radial spacing between a radially outer side of the second perforated outer wall and a radially inner side of the outer housing;

wherein the outer housing radially surrounds the first chamber and the second chamber;

wherein the first chamber is in fluidic communication with the flow in an interior of the first pipe section by a plurality of perforate holes in the first perforated outer wall;

wherein the second chamber is in fluidic communication with the first chamber by a plurality of perforate holes in the second perforated outer wall;

at least one first perforated partition plate extending radially from the radially outer side of the first perforated outer wall to the radially inner side of the second perforated outer wall, dividing the first chamber into a plurality of first sub-chambers, the at least one first perforated partition plate having a plurality of perforate holes extending through the at least one first perforated partition plate and fluidically connecting adjacent ones of the first sub-chambers.

2. The silencer according to claim 1, further comprising:

at least one second perforated partition plate extending radially from the radially outer side of the second perforated outer wall to the radially inner side of the outer housing, dividing the second chamber into a plurality of second sub-chambers, the at least one second perforated partition plate having a plurality of perforate holes extending through the at least one second perforated partition plate and fluidically connecting adjacent ones of the second sub-chambers.

3. The silencer according to claim 2, wherein wherein respective ones of the second sub-chambers are arranged radially outwardly from the respective ones of the first sub-chambers and fluidically connected by the plurality of perforate holes in the second perforated outer wall.

4. The silencer according to claim 1, wherein the first perforated outer is disposed concentrically with the second perforated outer wall.

5. The silencer according to claim 1, wherein wherein the first end pipe section and the second end pipe section are located at axial opposite sides of the first perforated outer wall.

6. The silencer according to claim 1, wherein the second chamber is configured so as to be completely located radially outside of the first chamber.

7. The silencer according to claim 1, wherein the second chamber is configured so as to only be in a partial circumferential region of the first perforated outer wall of the first pipe section.

8. The silencer according to claim 1, wherein the first perforated outer wall and the second perforated outer wall have a circular cross section or the first chamber and the second chamber have an annular cross section.

9. An air inlet system of a vehicle engine, wherein the air inlet system has a silencer as claimed in claim 1.

10. The silencer according to claim 1, wherein the second chamber and the first chamber have the same axial length and are aligned axially with each other.

11. A silencer, comprising:

an outer housing;

a first pipe section having a first perforated outer wall, the first perforated outer wall arranged in an interior of the outer housing;

a second pipe section having a second perforated outer wall, the second perforated outer wall arranged in the interior of the outer housing, the second perforated outer wall having a larger diameter than the first perforated outer wall such that the second perforated outer wall is spaced radially outwardly away from and surrounding the first perforated outer wall;

a first chamber defined by radial spacing between a radially outer side of the first perforated outer wall and a radially inner side of the second perforated outer wall in the interior of the outer housing;

a second chamber defined by radial spacing between a radially outer side of the second perforated outer wall and a radially inner side of the outer housing;

wherein the outer housing radially surrounds the first chamber and the second chamber;

wherein the first chamber is in fluidic communication with the flow in an interior of the first pipe section by a plurality of perforate holes in the first perforated outer wall;

wherein the second chamber is in fluidic communication with the first chamber by a plurality of perforate holes in the second perforated outer wall;

wherein the silencer has an annular flange wall connecting a radially outer side of the first pipe section to the outer housing, the annular end wall closing a first axial end of the first chamber and a first axial end of the second chamber, the annular flange wall having an annular receiving groove formed into an interior side of the annular end wall;

wherein an axial end of the second perforated outer wall is received into the annular receiving groove. outer wall.

12. The silencer according to claim 11, wherein the first pipe section forms the annular end wall having the annular receiving groove.

* * * * *